United States Patent [19]

Hwa

[11] 4,297,972

[45] Nov. 3, 1981

[54] DEVELOPMENT SYSTEM

[75] Inventor: Stephen C. P. Hwa, Penfield, N.Y.

[73] Assignee: Xerox Corporation, Stamford, Conn.

[21] Appl. No.: 91,296

[22] Filed: Nov. 5, 1979

[51] Int. Cl.[3] ..... G03G 15/09

[52] U.S. Cl. ..... 118/658; 118/648; 118/651; 118/653

[58] Field of Search ..... 118/657, 658, 623, 648, 118/651, 653; 355/3 DD

[56] References Cited

U.S. PATENT DOCUMENTS

| | | | |
|---|---|---|---|
| 3,543,720 | 12/1970 | Drexler et al. | 118/652 |
| 3,664,857 | 5/1972 | Miller | 430/123 |
| 3,703,395 | 11/1972 | Drexler et al. | 427/47 |

OTHER PUBLICATIONS

Paxton, K. B., *Customer-Controlled Copy Contrast, Frininess, and Edge Enhancement,* Disclosure No. 16,823, *Research Disclosure Journal,* Apr. 1978, p. 4.

*Primary Examiner*—Lawrence Evan K.
*Attorney, Agent, or Firm*—H. Fleischer; H. M. Brownrout

[57] ABSTRACT

An apparatus which develops a latent image by transporting a conductive developer material comprising marking particles into contact therewith successive times. During the first contact time, the conductivity of the developer material optimizes development of solid areas within the latent image with marking particles. The last contact time occurs with a developer material having a lower conductivity than the development material employed during the first contact time. In this way, development of lines within the latent image with marking particles is optimized during this latter contact time.

8 Claims, 4 Drawing Figures

DEVELOPMENT SYSTEM

This invention relates generally to an electrophotographic printing machine, and more particularly concerns an apparatus for developing a latent image.

In general, electrophotographic printing requires the utilization of a photoconductive member which is charged to a substantially uniform potential so as to sensitize the surface thereof. The charged portion of the photoconductive surface is exposed to a light image of an original document being reproduced. This records an electrostatic latent image on the photoconductive surface corresponding to the information areas contained within the original document. After the electrostatic latent image is recorded on the photoconductive surface, the latent image is developed by bringing a developer material into contact therewith. This forms a powder image on the photoconductive surface which is subsequently transferred to a copy sheet. Finally, the copy sheet is heated to permanently fuse the powder image thereto in image configuration.

Frequently, the developer material comprises toner particles adhering triboelectrically to carrier granules. This two component mixture is brought into contact with the latent image. The toner particles are attracted from the carrier granules to the latent image forming a powder image thereof. Hereinbefore, it has been difficult to develop both the large solid areas of the latent image uniformly and the low density lines thereof. Different techniques have generally been utilized to improve solid area development. For example, a development electrode is frequently employed to improve solid area development. This approach is often used in conjunction with multi-roller magnetic brush development systems. However, systems of this type are rather complex and have suffered from poor development latitude or low density.

It has been found that both line development and solid area development are affected by whether or not there is a fringe field component in the total development field. Generally, when the fringe field component is increased, solid area density is usually reduced and low density line development improved. In multi-roll magnetic brush development systems, line development appears to be controlled by the last developer roller contacting the photoconductive surface prior to transfer of the powder image to the copy sheet. However, solid area development is strongly influenced by the other developer rollers in the system, not merely the last developer roller. When conductive developer materials are employed, the conductance in the development nip, i.e the gap between the developer roller and photoconductive surface, controls the proportion of the magnetic fringe field component. Lowering the nip conductance will increase the fringe field component. In addition, the nip conductance can also be altered by the developer roller set-up parameters such as magnetic field strength, and the distance between the developer roller and the photoconductive surface.

Various approaches have been devised to improve development. The following disclosures appear to be relevant:

U.S. Pat. No. 3,543,720
Patentee: Drexler et al.
Issued: Dec. 1, 1970

U.S. Pat. No. 3,703,395
Patentee: Drexler et al.
Issued: Nov. 21, 1972

Research Disclosure Journal
April, 1978
Page 4, No. 16823
Disclosed by: Paxton

Co-pending U.S. patent application Ser. No. 34,095
Filed: Apr. 27, 1979
Applicant: Huggins The pertinent portions of the foregoing disclosure may be briefly summarized as follows:

The Drexler et al. patents disclose two magnetic brushes arranged so that the feed brush feeds developer material to the discharge brush. The feed brush is spaced further from the insulating surface having the electrostatic charge pattern thereon than the discharge brush. In FIG. 3 of Drexler et al. (U.S. Pat. No. 3,703,395), the feed portion of the brush contains stronger magnets than the discharge portion.

Paxton describes a magnetic brush in which the conductivity of the developer material in the nip between the brush and the photoconductor is adjusted by varying the amount or density of the developer material in the nip. To provide improved copy contrast, and fringiness between solid area and line development, the amount of developer in the nip and/or the electrical bias applied to the magnetic brush is selectively adjusted.

Huggins discloses a multi-roll magnetic brush development system in which the first magnetic brush roller interacts with the developer composition causing the developer material to have a higher conductivity than the conductivity of the developer material in the region of the second magnetic brush developer roller. The solid areas of the latent image are developed with the higher conductivity developer material with lines being developed with the lower conductivity developer material.

In accordance with the present invention, there is provided an apparatus for developing a latent image. The apparatus includes means for transporting a conductive developer material comprising marking particles into contact with the latent image at least two successive times. Means, interacting with the developer material contacting the latent image, maintain the developer material at a first conductivity to optimize development of solid areas with the marking particles the final contact time and at a second conductivity lower than the first conductivity to optimize development of lines with marking particles the last contact time.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
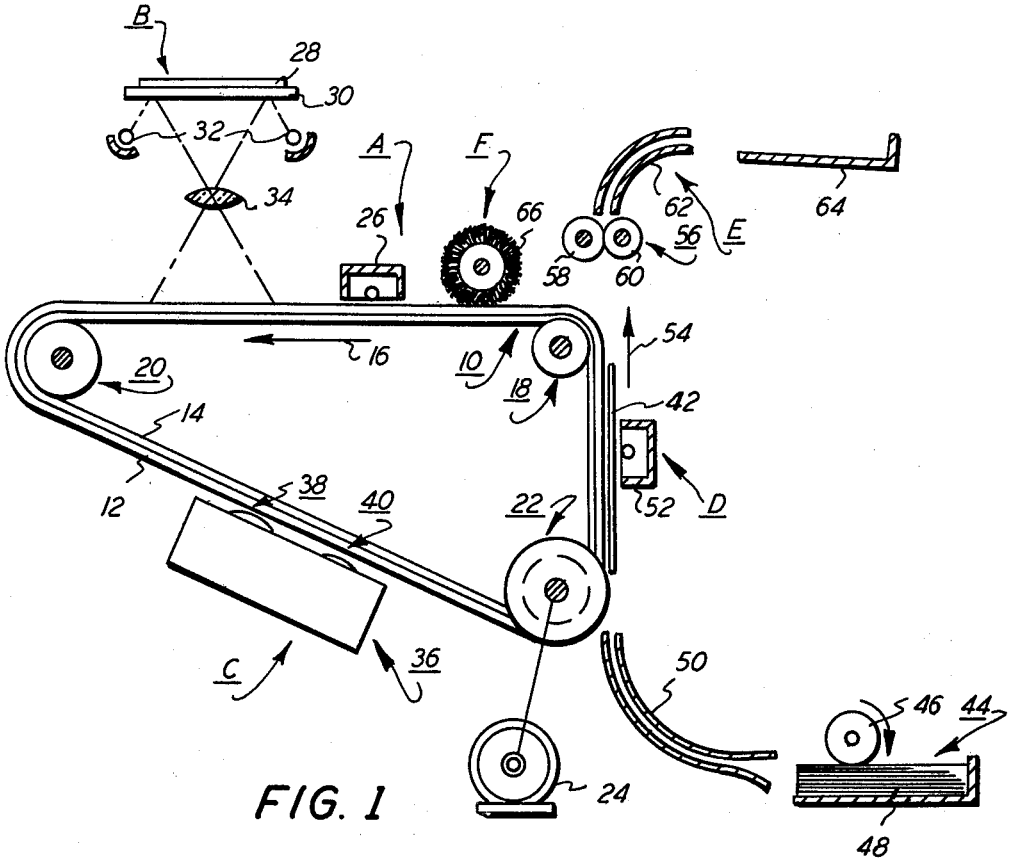
FIG. 1 is a schematic elevational view depicting an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the development apparatus of the present invention therein. It will become apparent from the following description that this development apparatus is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 sequentially through the various processing stations disposed about the path of movement thereof. Belt 10 is entrained about a stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced edge guides. The edge guides define a space therebetween which determines the desired path of movement for belt 10. Belt 10 is maintained in tension by a pair of springs (not shown) resiliently urging tension roller 22 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Thereafter, belt 10 advances the electrostatic latent image recorded on photoconductive surface 12 to development station C. At development station C, a magnetic brush development system, indicated generally by the reference numeral 36, advances a conductive developer material into contact with the electrostatic latent image. Preferably, magnetic brush development system 36 includes two magnetic brush developer rollers 38 and 40. These rollers each advance the developer material into contact with the latent image. Each developer roller forms a brush comprising carrier granules and toner particles. The latent image attracts the toner particles from the carrier granules forming a toner powder image on photoconductive surface 12 of belt 10. It is thus clear that each magnetic brush developer roller advances developer material into contact with a common latent image. Developer roller 38 transports the developer material into contact with the latent image the first time with developer roller 40 transporting the developer material into contact with the latent image the last time. Developer rollers 38 and 40 are mounted on brackets which include slots therein. These slots permit the developer rollers to be moved toward and away from belt 10. In this way, each developer roller may be positioned a discrete distance from belt 10 and locked in position. Other suitable adjustable means may be employed to locate each developer roller in the desired position. The detailed structure of magnetic brush development system 36 will be described hereinafter with reference to FIG. 2.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates so as to advance the uppermost sheet from stack 48 into chute 50. Chute 50 directs the advancing sheet of support material into contact with photoconductive surface 12 of belt 10 in a timed sequence so that the toner powder image developed thereon contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move, in the direction of arrow 54, onto a conveyor (not shown) which advances the sheet to fusing station E.

Fusing station E includes a fuser assembly, indicated generally by the reference numeral 56, which permanently affixes the transferred powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is permanently affixed to sheet 42. After fusing, chute 62 guides the advancing sheet 42 to catch tray 64 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 66 in contact with photoconductive surface 12. The particles are cleaned from photoconductive surface 12 by the rotation of brush 66 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
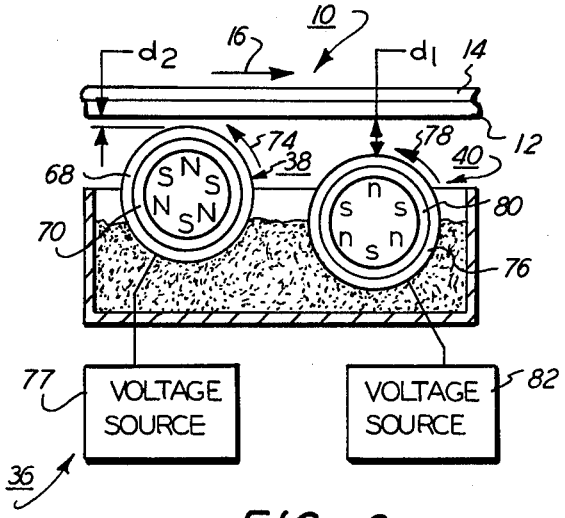
FIG. 2 is a schematic elevational view showing the development system employed in the FIG. 1 printing machine.

Referring now to the specific subject matter of the present invention, solid areas of the electrostatic latent image are optimumly developed by a highly conductive developer material. However, lines within the electrostatic latent image are optimumly developed with a developer composition of a lower conductivity. Under controlled conditions, the conductivity of the developer material may be varied to achieve both of the foregoing objectives. FIG. 2 depicts, in detail, development system 36 which is designed to achieve the foregoing. As depicted thereat, developer roller 38 includes a non-magnetic tubular member 68 journaled for rotation. Preferably, tubular member 68 is made from aluminum having the exterior circumferential surface thereof roughened. An elongated magnetic rod 70 is positioned concentrically within tubular member 68 being spaced from the interior surface thereof. Magnetic rod 70 has a plurality of magnetic poles impressed thereon which generate a magnetic field attracting the developer material to tubular member 68. By way of example, magnetic rod 70 is made from barium ferrite.

Tubular member 68 is electrically biased by voltage source 72. Voltage source 72 supplies a potential having a suitable polarity and magnitude to electrically bias tubular member 68. Preferably, tubular member 68 is electrically biased to a voltage intermediate the background voltage and the image voltage, i.e. between 50 volts and 350 volts. A motor (not shown) rotates tubular member 68 at a substantially constant angular velocity. A brush of developer material is formed on the exterior circumferential surface of tubular member 68. As tubular member 68 rotates in the direction of arrow 74, the brush of developer material advances into contact with the latent image. The toner particles are attracted from the carrier granules to the latent image forming a toner powder image on photoconductive surface 12.

Magnetic brush developer roller 40 includes a non-magnetic tubular member 76 journaled for rotation in the direction of arrow 78. A magnetic rod 80 is disposed concentrically within tubular member 76 being spaced from the interior surface thereof. By way of example, tubular member 76 is made preferably from aluminum having a roughened exterior circumferential surface. Magnetic rod 80 is preferably made from barium ferrite having a plurality of magnetic poles impressed thereon.

Voltage source 82 electrically biases tubular member 76 to a suitable potential and magnitude, e.g. between 50 volts and 350 volts. A motor (not shown) rotates tubular member 76 at a constant angular velocity to advance the developer material into contact with the latent image.

With continued reference to FIG. 2, tubular member 76 is spaced a distance $d_1$ from photoconductive surface 12 with tubular member 68 being spaced a distance $d_2$ therefrom. The distance $d_1$ is greater than the distance $d_2$. The magnetic field generated by the magnetic poles impressed on magnetic rod 70 is greater than the magnetic field generated by the magnetic poles impressed on magnetic rod 80. Thus, the conductivity of the developer material in the region of developer roller 38 is greater than the conductivity of the developer material in the region of developer roll 40. It is apparent that developer roll 38 is designed to optimize development of solid areas within the latent image while developer roller 40 optimizes development of lines within the latent image. By way of example, magnetic rod 70 has a magnetic field of about 500 gauss. Tubular member 68 is positioned so as to be spaced a distance ($d_2$) of about 0.22 millimeters from photoconductive surface 12. Magnetic rod 80 has a magnetic field of about 250 gauss with tubular member 76 being positioned so as to be spaced a distance ($d_1$) of about 0.3 millimeters from photoconductive surface 12. With the foregoing set of parameters, the developer material has a conductivity of $5\times10^{-11}$ (ohm-centimeters)$^{-1}$. A development system of this type is capable of reproducing an original document which has a 0.2 density line and a 0.9 density solid area patch as copy having a 0.3 density line output and a 1.1 density solid area output. The foregoing results are highly satisfactory for producing high quality copies.

Developer materials that are particularly useful in this type of development system comprise magnetic carrier granules having toner particles adhering thereto triboelectrically. More particularly, the carrier granules include a ferromagnetic core having a thin layer of magnetite overcoated with a non-continuous layer of resinous material. Suitable resins include poly(vinylidene fluoride) and poly(vinylidene fluorideco-tetrafluorethylene) The developer composition can be prepared by mixing the carrier granules with toner particles. Generally, any of the toner particles known in the art are suitable for mixing with the carrier granules. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinyl acetals, polyvinyl ether and polyacrylic. Suitable coloring materials may be amongst others, chromogen black and solvent black. The developer material comprises from about 95% to about 99% by weight of carrier and from about 5% to about 1% weight of toner. These and other materials are disclosed in U.S. Pat. No. 4,076,857, issued to Kasper et al. in 1978. The relevant portions thereof being hereby incorporated into the present application.

Figure 3:
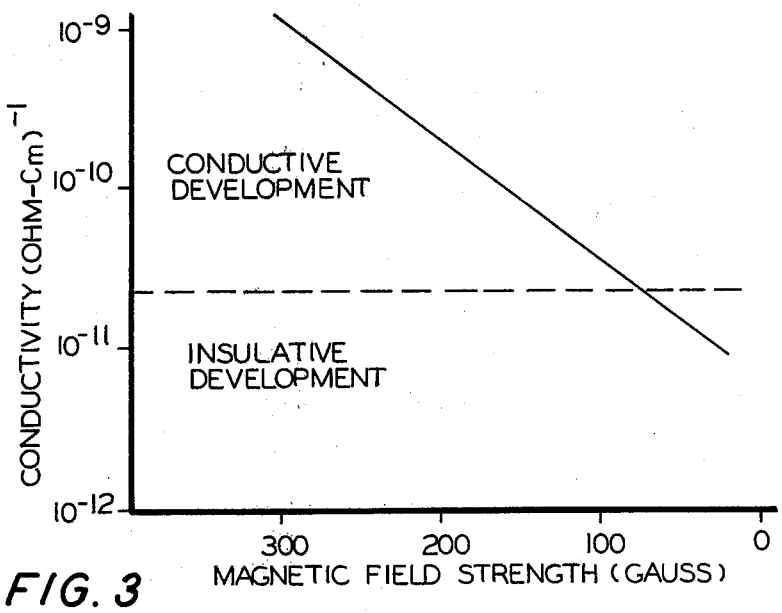
FIG. 3 is a graph illustrating developer material conductivity as a function of magnetic field strength.

Referring now to FIG. 3, there is shown a graph of the developer material conductivity as a function of the magnetic field strength. It is seen that the conductivity varies from about $10^{-9}$ to less than $10^{-11}$ (ohm-centimeters)$^{-1}$ as the magnetic field strength varies from about 300 to about 50 gauss. The magnetic field strength is changed by adjusting the strength of the magnetic poles impressed upon the magnetic member or by rotating the poles of the magnetic field relative to the nip of the development zone. The magnetic field may be maximized by placing a magnetic pole opposed from the photoconductive surface in the nip of the development zone and reduced by moving the poles away from the nip of the development zone or by positioning weak magnetic poles opposed from the photoconductive surface in the nip of the development zone. As shown in the graph, the conductivity of the developer material decreases as the magnetic field strength decreases. A highly conductive developer material optimizes development of solid areas in the electrostatic latent image. However, low density lines in the electrostatic latent image are optimumly developed by a developer material having a lower conductivity. Thus, it is seen that it is highly desirable to be capable of having two different types of developer materials, i.e. a highly conductive material for developing solid areas and a relatively low conductive material for developing lines.

Figure 4:
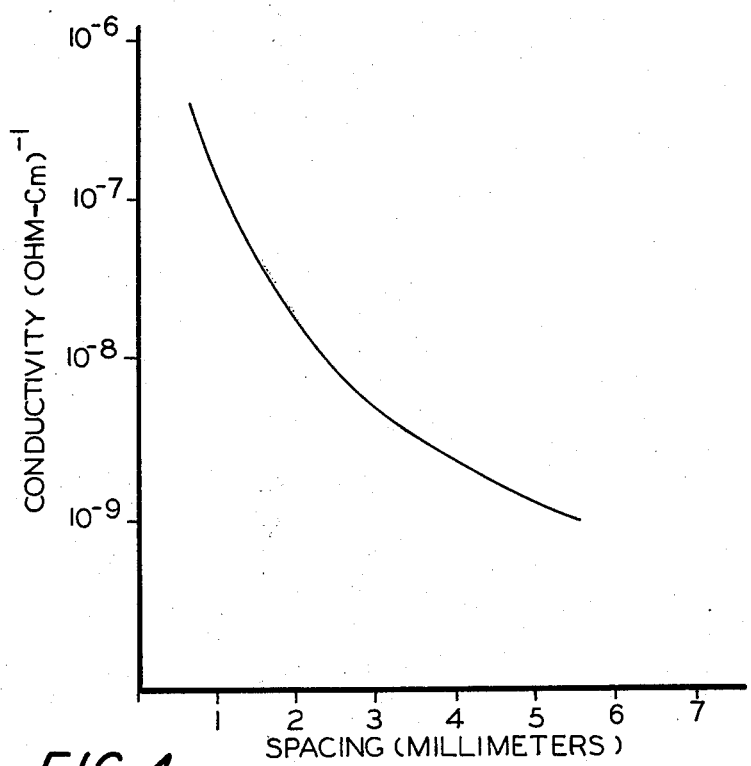
FIG. 4 is a graph depicting developer material conductivity as a function of the spacing between the developer roller and the photoconductive surface.

Referring now to FIG. 4, the variation of developer material conductivity as a function of the spacing of the developer roller from the photoconductive surface is depicted thereat. As shown therein, the conductivity of the developer material varies inversely with the spacing, i.e. as the spacing between the tubular member and photoconductive surface increases, conductivity of the developer material decreases. The developer material conductivity varies from about $10^{-7}$ (ohm-centimeters)$^{-1}$ at 1 millimeter spacing to about $10^{-9}$ (ohm-centimeters)$^{-1}$ at about 6 millimeters. It is evident that there are two independent variables which affect conductivity of the developer material, i.e. the strength of the magnetic field and the spacing of the tubular member from the photoconductive surface. These parameters may be varied independently. Ideally, the parameters should be varied to reinforce one another, thereby optimizing development.

In recapitulation, it is evident that the development apparatus of the present invention achieves optimum solid area and line development by utilizing a two developer roller system. The first developer roller has a stronger magnetic field and is positioned closely adjacent to the photoconductive surface. The conductivity of the developer material for this developer roller is relatively high, thereby optimizing development of the solid areas within the electrostatic latent image. The second or last developer roller has a weaker magnetic field and is spaced a relatively greater distance from the photoconductive surface. Thus, the conductivity of the developer material is maintained significantly lower. The last developer roller optimizes development of lines within the electrostatic latent image. Hence, solid area development is optimized during the first contact time with line development being optimized during the last contact time.

It is, therefore, apparent that there has been provided in accordance with the present invention an apparatus for developing an electrostatic latent image that optimizes development of both the solid areas and lines contained therein. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image, including:

means for transporting a conductive developer material comprising a ferromagnetic carrier material and marking particles into contact with the latent image at least two successive times, means for generating a first magnetic field for attracting the carrier material to maintain the developer material at a first conductivity to optimize development of solid areas with the marking particles the first contact time, and means for generating a second magnetic field for attracting the carrier material to maintain the developer material at a second conductivity lower than the first conductivity to optimize development of lines with the marking particles the last contact time.

2. An apparatus as recited in claim 1, wherein said transporting means includes:

a first non-magnetic tubular member journaled for rotary movement to transport the developer material into contact with the latent image the first contact time, said first tubular member being spaced from the latent image; and a second non-magnetic tubular member journaled for rotary movement to transport the developer material into contact with the latent image the last contact time, said second tubular member being spaced from the latent image.

3. An apparatus as recited in claim 2, wherein said second tubular member is spaced a greater distance from the latent image than said first tubular member.

4. An apparatus as recited in claim 3, wherein:

said first magnetic field generating means includes a first elongated member disposed interiorly of said first tubular member and having a plurality of magnetic poles impressed thereon; and said second magnetic field generating means includes a second elongated member disposed interiorly of said second tubular member and having a plurality of magnetic poles impressed thereon with the magnetic poles of said first member generating a stronger magnetic field than the magnetic field being generated by the magnetic poles of said second member.

5. An electrophotographic printing machine of the type having an electrostatic latent image recorded on a photoconductive member, wherein the improvement includes:

means for transporting a conductive developer material comprising a ferromagnetic carrier material and marking particles into contact with the latent image recorded on the photoconductive member at least two successive times, means for generating a first magnetic field for attracting the carrier material to maintain the developer material at a first conductivity to optimize development of solid areas with the marking particles the first contact time, and means for generating a second magnetic field for attracting the carrier material to maintain the developer material at a second conductivity lower than the first conductivity to optimize development of lines with the marking particles the last contact time.

6. A printing machine as recited in claim 5, wherein said transporting means includes:

a first non-magnetic tubular member journaled for rotary movement to transport the developer material into contact with the latent image the first contact time, said first tubular member being spaced from the photoconductive member; and a second non-magnetic tubular member journaled for rotary movement to transport the developer material into contact with the latent image the last contact time, said second tubular member being spaced from the photoconductive member.

7. A printing machine as recited in claim 6, wherein said second tubular member is spaced a greater distance from the photoconductive member than the first tubular member.

8. A printing machine as recited in claim 7, wherein: said first magnetic field generating means includes a first elongated member disposed interiorly of said first tubular member and having a plurality of magnetic poles impressed thereon; and said second magnetic field generating means includes a second elongated member disposed interiorly of said second tubular member and having a plurality of magnetic poles impressed thereon with the magnetic poles of said first member generating a stronger magnetic field than the magnetic field being generated by the magnetic poles of said second magnetic member.

* * * * *